US007066432B2

(12) United States Patent
Wood et al.

(10) Patent No.: US 7,066,432 B2
(45) Date of Patent: Jun. 27, 2006

(54) REFUSE BAG SUPPORTING DEVICE

(75) Inventors: Gregory J. Wood, Carrollton, TX (US); Andy T. Ng, Dallas, TX (US)

(73) Assignee: Olympic General Corporation, Henderson, NV (US)

( * ) Notice: Subject to any disclaimer, the term of this patent is extended or adjusted under 35 U.S.C. 154(b) by 177 days.

(21) Appl. No.: 10/669,838

(22) Filed: Sep. 24, 2003

(65) Prior Publication Data

US 2005/0061929 A1 Mar. 24, 2005

(51) Int. Cl.
*B65B 67/04* (2006.01)

(52) U.S. Cl. ..... 248/99; 248/150; 248/166

(58) Field of Classification Search ..... 248/99, 248/95, 97, 101, 150, 151, 149, 166, 436, 248/439

See application file for complete search history.

(56) References Cited

U.S. PATENT DOCUMENTS 1,542,164 A * 6/1925 Nelson ..... 248/97
2,451,829 A * 10/1948 Hightower ..... 248/100
3,838,838 A * 10/1974 Seaman, Jr. ..... 248/537
4,069,993 A * 1/1978 Shanks ..... 248/97
4,174,085 A * 11/1979 Ferreira et al. ..... 248/97
4,273,167 A * 6/1981 Stillwell ..... 141/314
4,304,378 A * 12/1981 Briggs ..... 248/97
4,562,983 A * 1/1986 Klefbeck ..... 248/97
4,684,087 A * 8/1987 Spickard ..... 248/97
4,810,031 A * 3/1989 Patterson ..... 297/188.12
5,016,844 A * 5/1991 Garvin ..... 248/97
D325,798 S * 4/1992 Montrose et al. ..... D34/5
D326,172 S * 5/1992 Biesele et al. ..... D34/5
5,180,126 A * 1/1993 Bennett ..... 248/99
5,195,649 A * 3/1993 Wolters ..... 220/848
5,308,027 A * 5/1994 Fullilove ..... 248/101
D396,917 S * 8/1998 McCray, Jr. ..... D34/5
6,076,782 A * 6/2000 Alderman ..... 248/97
6,164,607 A * 12/2000 Hawkes ..... 248/97
6,199,802 B1 * 3/2001 Scheibe, Sr. ..... 248/97
D447,845 S * 9/2001 Neil ..... D34/6
6,511,026 B1 * 1/2003 Hatfield ..... 248/97
6,511,110 B1 * 1/2003 Roye ..... 294/1.1
6,676,092 B1 * 1/2004 Tsai ..... 248/97
6,752,729 B1 * 6/2004 Huang ..... 473/476

* cited by examiner

*Primary Examiner*—Anita M. King
(74) *Attorney, Agent, or Firm*—G. Harvey Dunn, III

(57) ABSTRACT

A refuse bag supporting device comprises a refuse bag supporting frame and a plurality of legs which are both pivotal relative to the frame and retractable to facilitate supporting refuse bags either vertically or horizontally and to facilitate convenient storage of the refuse bag supporting device.

1 Claim, 17 Drawing Sheets

FIG. 17
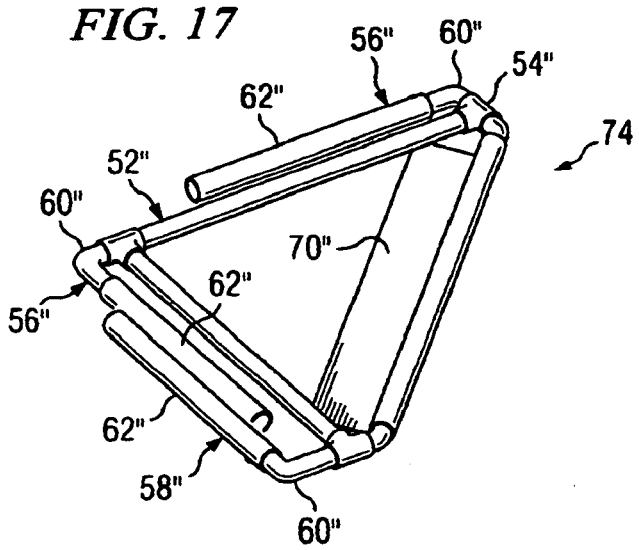
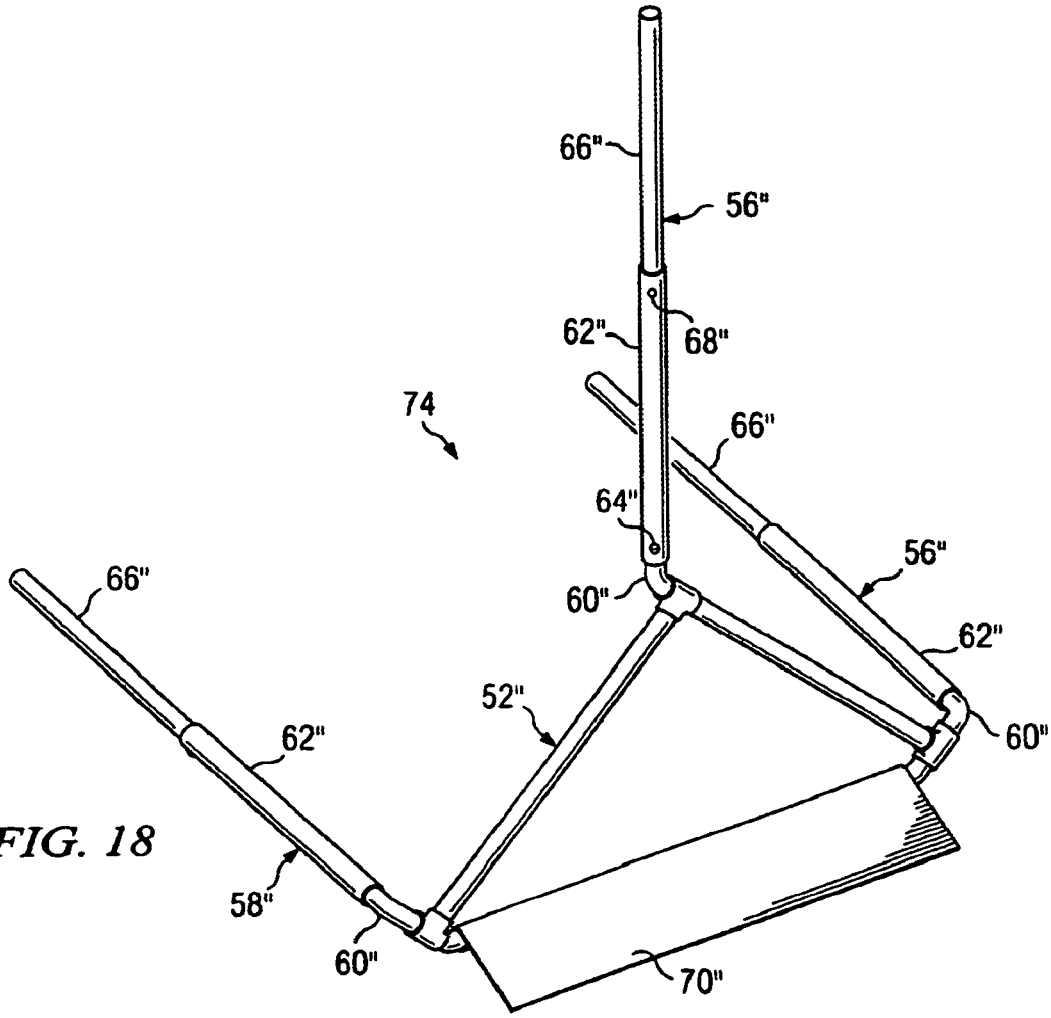
FIG. 18

REFUSE BAG SUPPORTING DEVICE

TECHNICAL FIELD

This invention relates generally to the support of refuse bags for the receipt of refuse therein, and more particularly to a refuse bag supporting device comprising components which are both retractable and pivotal to facilitate supporting refuse bags either vertically or horizontally and to facilitate convenient storage of the device when not in use.

BACKGROUND AND SUMMARY OF THE INVENTION

U.S. Pat. No. 6,511,110 discloses a refuse collection tool adapted to support refuse bags either vertically or horizontally. The device comprises a refuse bag supporting frame and a plurality of clamping members which secure the refuse bag into engagement with the frame. A plurality of legs are detachably secured to the frame for supporting the refuse bag in a vertical orientation. When the refuse bag is supported horizontally, the legs are detached from the frame with one of the legs being reattached to the frame in a different orientation to serve as a handle.

As will therefore be understood, the refuse collecting tool of the '110 patent incorporates numerous inherent problems. First, detaching and reattaching the legs of the device is awkward at best. Second, since two of the legs are detached when the device is used to support refuse bags horizontally, the opportunity exists for the detached legs to become lost or damaged. Third, the device is difficult to store since there is no convenient way of securing the detached legs to the frame to facilitate storage. Fourth, in actual practice it has been found that the clamping members which are used to secure refuse bags to the frame are difficult to engage and disengage. Fifth, since the clamping members must be removed in order to secure refuse bags to and remove refuse bags from the device, the possibility exists for the clamping members to become lost or damaged.

The present invention comprises a refuse bag supporting device which overcomes the foregoing and other problems which have long since characterized the prior art. In accordance with the broader aspects of the invention, a refuse bag supporting device comprises a bag receiving frame and a plurality of frame support members which are both retractable and pivotal to facilitate supporting refuse bags either vertically or horizontally and to facilitate storage. The invention further comprises a plurality of refuse bag attachment device which are easy to use and which are permanently secured to the frame of the refuse bag supporting device.

BRIEF DESCRIPTION OF THE DRAWINGS

A more complete understanding of the invention may be had by reference to the following Detailed Description when taken in conjunction with the accompanying Drawings, wherein:

FIG. 17 is a perspective view showing the device of FIG. 15 in a third orientation;

FIG. 18 is a perspective view showing the device of FIG. 15 in a fourth orientation;

DETAILED DESCRIPTION

Figure 1:
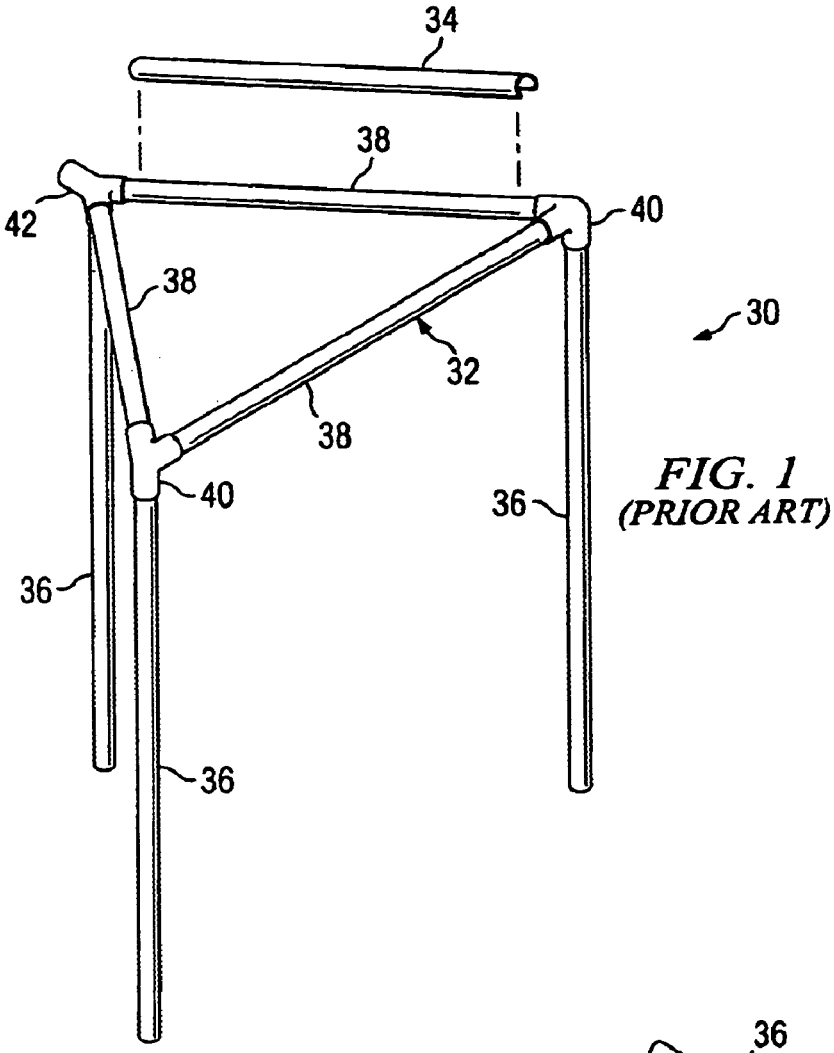
FIG. 1 (PRIOR ART)
FIG. 1 is a perspective view showing a prior art refuse bag supporting device in a first orientation.
Figure 2:
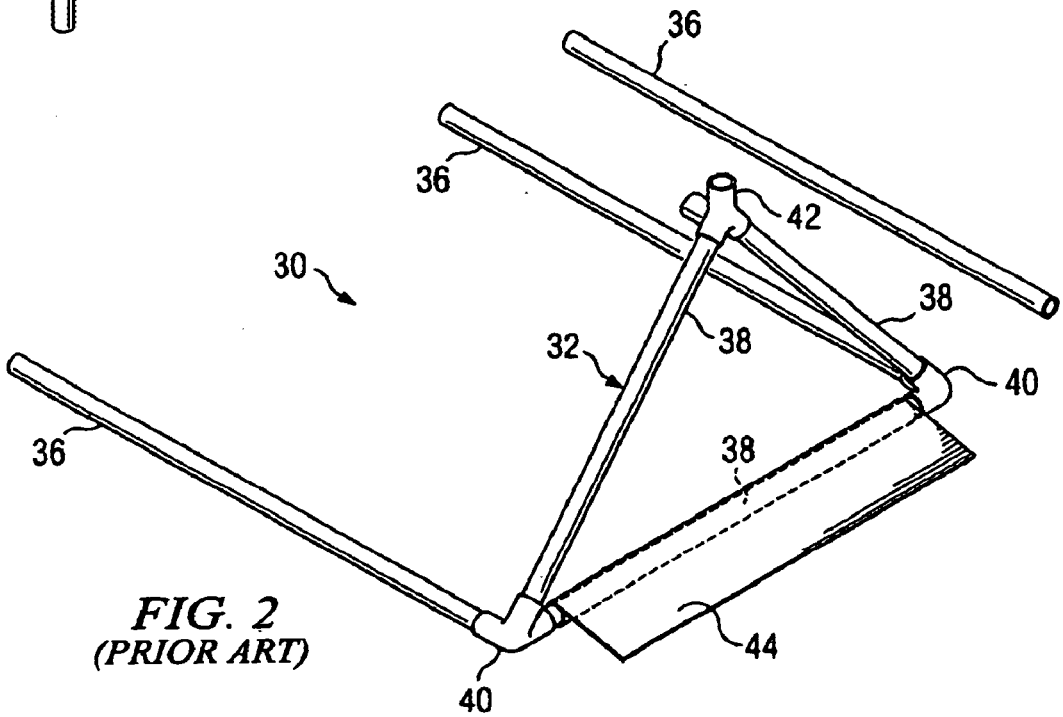
FIG. 2 (PRIOR ART)
FIG. 2 is a perspective view showing the device of FIG. 1 in a different orientation.
Figure 3:
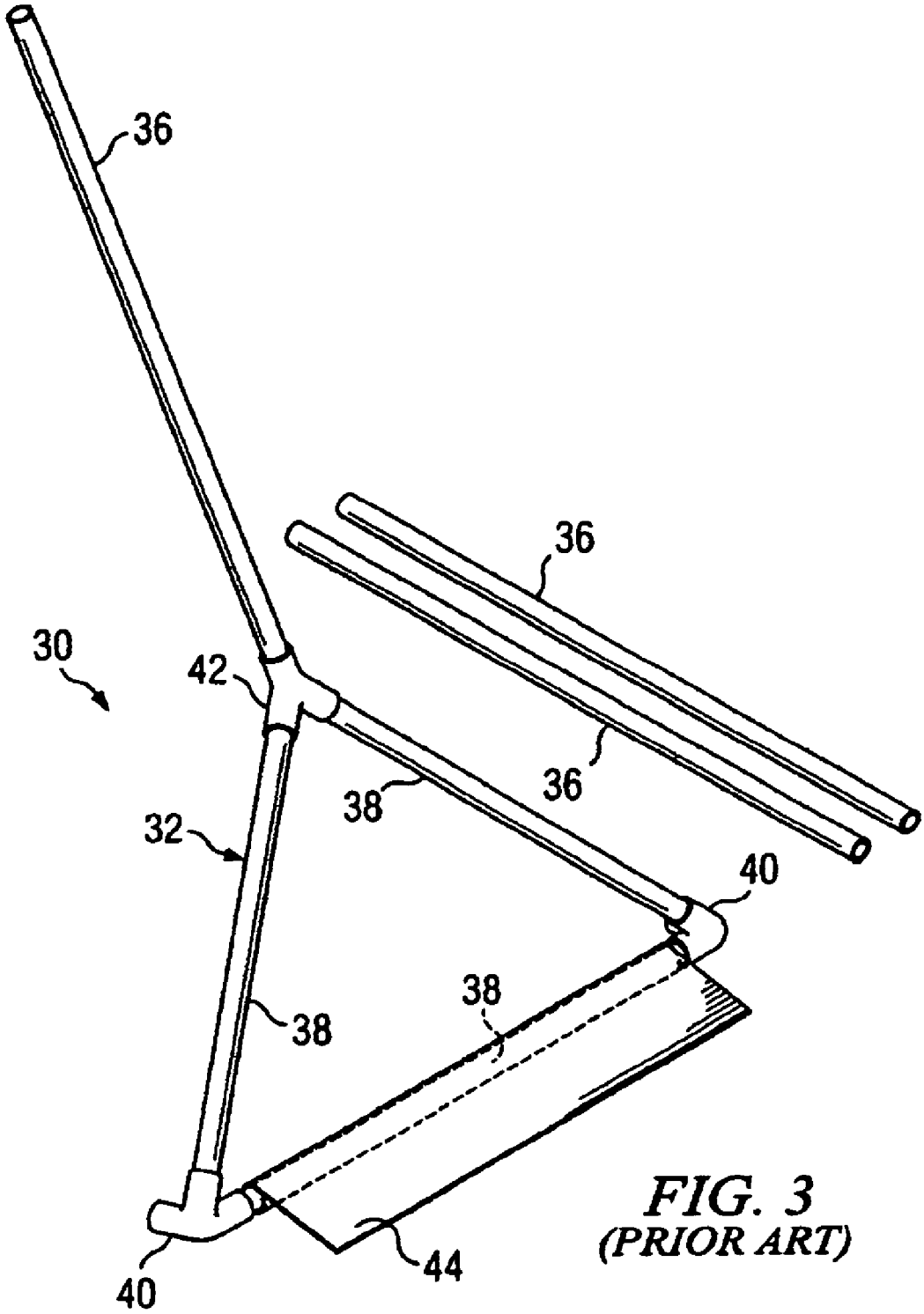
FIG. 3 (PRIOR ART)
FIG. 3 is a perspective view showing the device of FIG. 1 in a still different orientation.

Referring now to the Drawings, and particularly to FIGS. 1, 2, and 3 thereof, there is shown a prior art refuse bag support device 30. The device 30 comprises a frame 32 which is employed to receive and support a refuse bag. Clamping members 34 are utilized to secure a refuse bag in engagement with the frame 32. The device 30 further comprises a plurality of legs 36 which are detachably engagable with the frame 32, and which are utilized to position the frame 32 either as illustrated in FIG. 1 wherein a refuse bag secured to the frame 32 is positioned vertically, or as illustrated in FIGS. 2 and 3 wherein a refuse bag secured to the frame is positioned horizontally.

The frame 32 comprises three identical tubes 38 which are secured one to another by corner members 40 and 42. The corner members 40 are identical and each comprise two connectors for receiving the tubes 38 of the frame 32 and one connector for detachably receiving one of the legs 36. The corner member 42 differs from the corner members 40 in that it comprises an additional connector for detachably receiving one of the legs 36 in the orientation illustrated in FIG. 3.

FIG. 1 illustrates the refuse bag supporting device 30 with the three legs 36 each engaged with one of the corner members 40 and 42. The legs 36 position the frame 32 in a more or less horizontal plane. The frame 32 is thus positioned to receive and support a refuse bag with the bag oriented vertically. The bag is secured to the frame 32 by the clamping members 34.

FIG. 2 illustrates the refuse bag supporting device 30 with one of the legs 36 removed and with the two remaining legs 36 engaging the underlying surface. The frame 32 is oriented more or less vertically such that a refuse bag secured to the frame 32 is oriented horizontally. Again, the refuse bag is secured to the frame 32 by the clamping members 34.

FIG. 3 illustrates the refuse bag supporting device 30 with two of the legs 36 removed and with the third leg 36 detachably secured to the corner member 42 and extending in the plane of the frame 32. The leg 36 is thus oriented to effect manipulation of the frame 32 and a refuse bag secured thereto. FIGS. 2 and 3 also illustrate the use of a ramp 44 which may be detachably secured to the frame member 38 located opposite from the corner member 42 to facilitate the filling of a refuse bag with refuse.

Referring to FIGS. 4 through 9, inclusive, there is shown a refuse bag supporting device 50 comprising a first embodiment of the present invention. The device 50 includes a frame 52 which receives and supports a refuse bag. The frame 52 comprises four tubular structural members 53 which are connected one to another by corner members 54. A plurality of legs 56 and 58 are pivotally connected to the corner members 54. Having particular reference to FIGS. 4 and 5, the legs 56 are located relatively inwardly relative to the frame 52 and the legs 58 are located relatively outwardly therefrom.

Each of the legs 56 and 58 comprises an L-shaped member 60 which is pivotally connected to one of the corner members 54. Each leg 56 and 58 further comprises a relatively large diameter tubular member 62 which is secured to the adjacent L-shaped member 60 by a bayonet connector 64. Each leg 56 and 58 further includes a relatively small diameter tubular member 66 which is secured to the relatively large diameter tubular member 62 by a bayonet connector 68.

Figure 4:
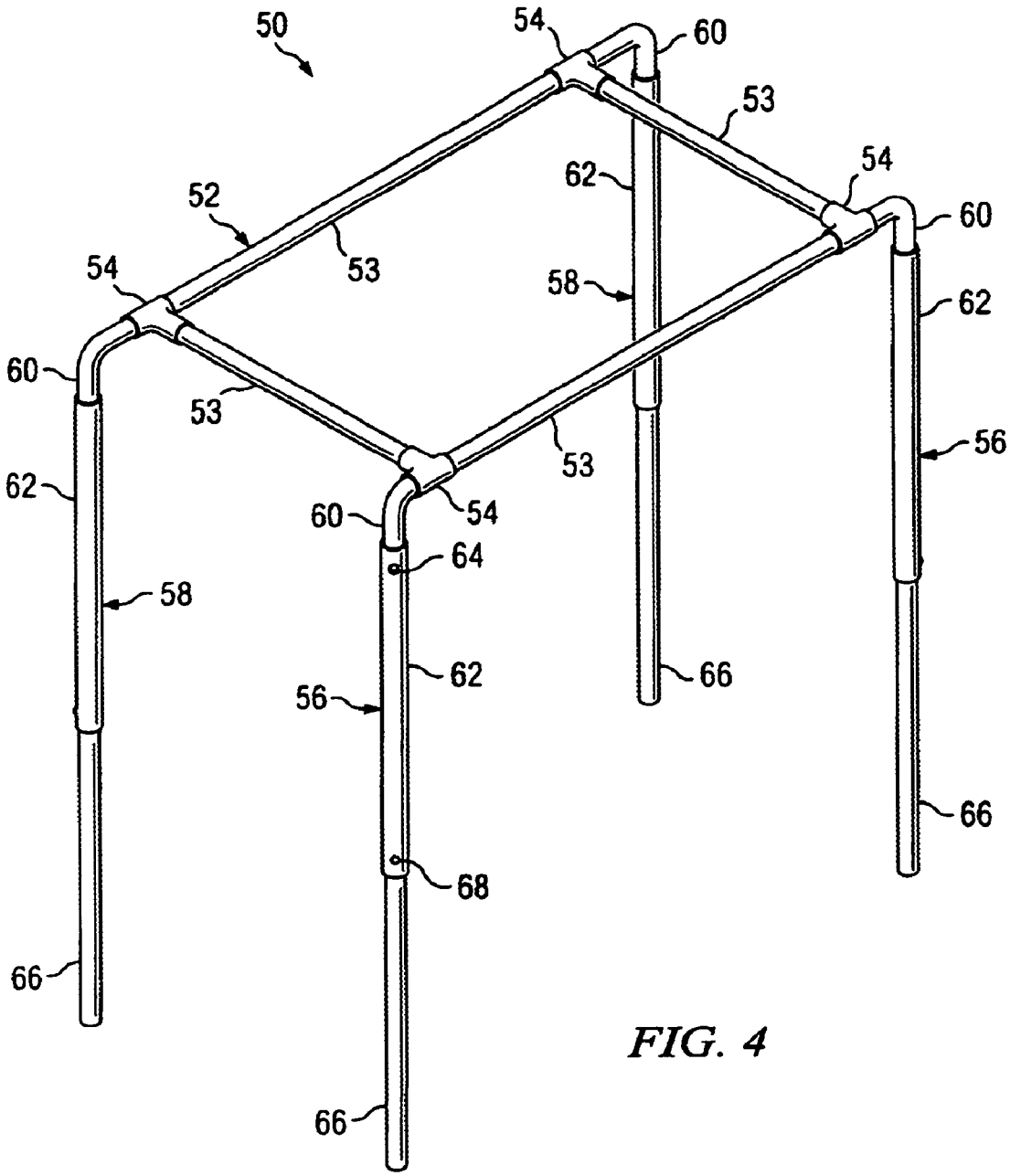
FIG. 4 is a perspective view showing a refuse bag supporting device comprising a first embodiment of the present invention in a first orientation.
Figure 5:
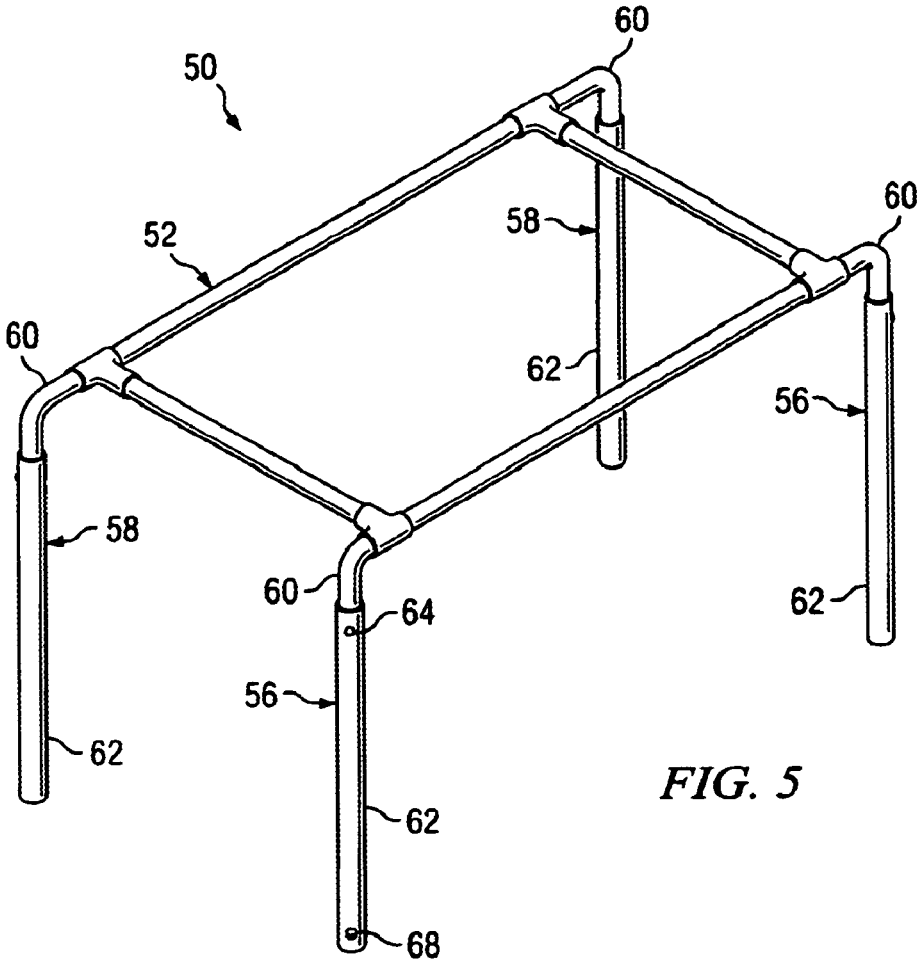
FIG. 5 is a perspective view showing the device of FIG. 4 in a second orientation.

FIG. 4 illustrates the refuse bag supporting device 50 with the legs 56 and 58 thereof fully extended. This positions the frame 52 of the device 50 at a height convenient for receiving and supporting a relatively long refuse bag. FIG. 5 illustrates the refuse bag supporting device 50 with the relatively small diameter sections 66 of the legs 56 and 58 retracted into the relatively large diameter sections 62 thereof. This positions the frame 52 of the device 50 at a reduced height suitable for receiving the supporting relatively short refuse bags.

Figure 6:
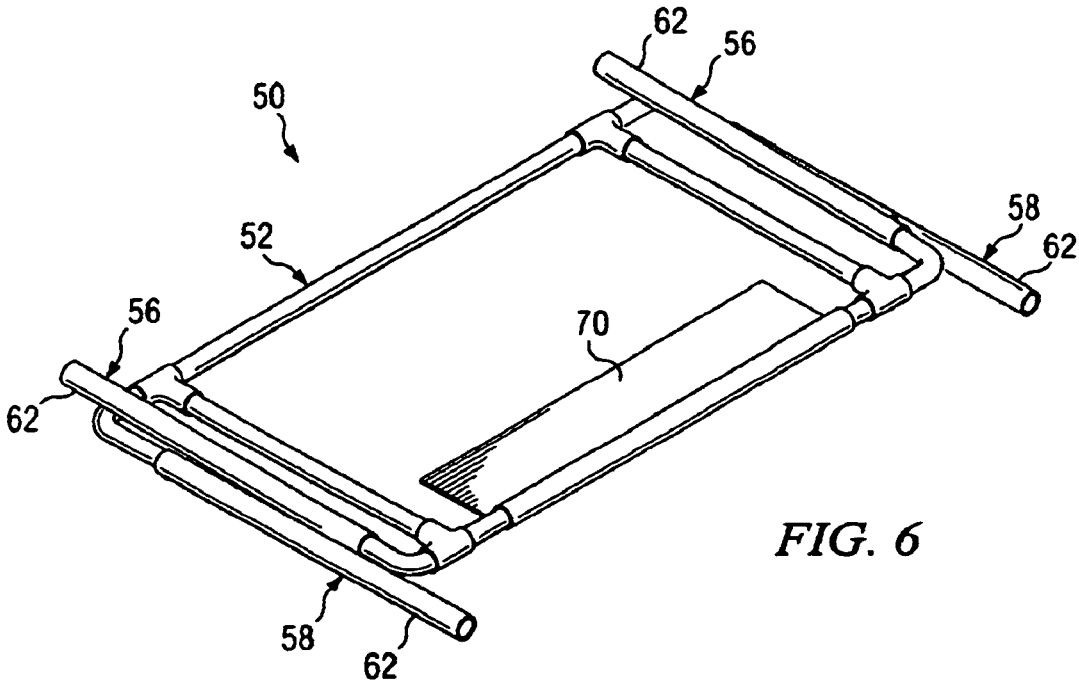
FIG. 6 is a perspective view showing the device of FIG. 4 in a third orientation.

FIG. 6 illustrates the refuse bag supporting device 50 folded for storage, transportation, etc. Folding of the device 50 is accomplished by retracting the small diameter sections of the legs 56 and 58 into the large diameter sections 66 thereof, pivoting the legs 56 toward the legs 58 and pivoting the legs 58, toward the legs 56. Because the legs 56 are positioned relatively inwardly and the legs 58 are positioned relatively outwardly relative to the frame 52, the legs 56 fold into the space between the legs 58 and the frame 52.

Figure 7:
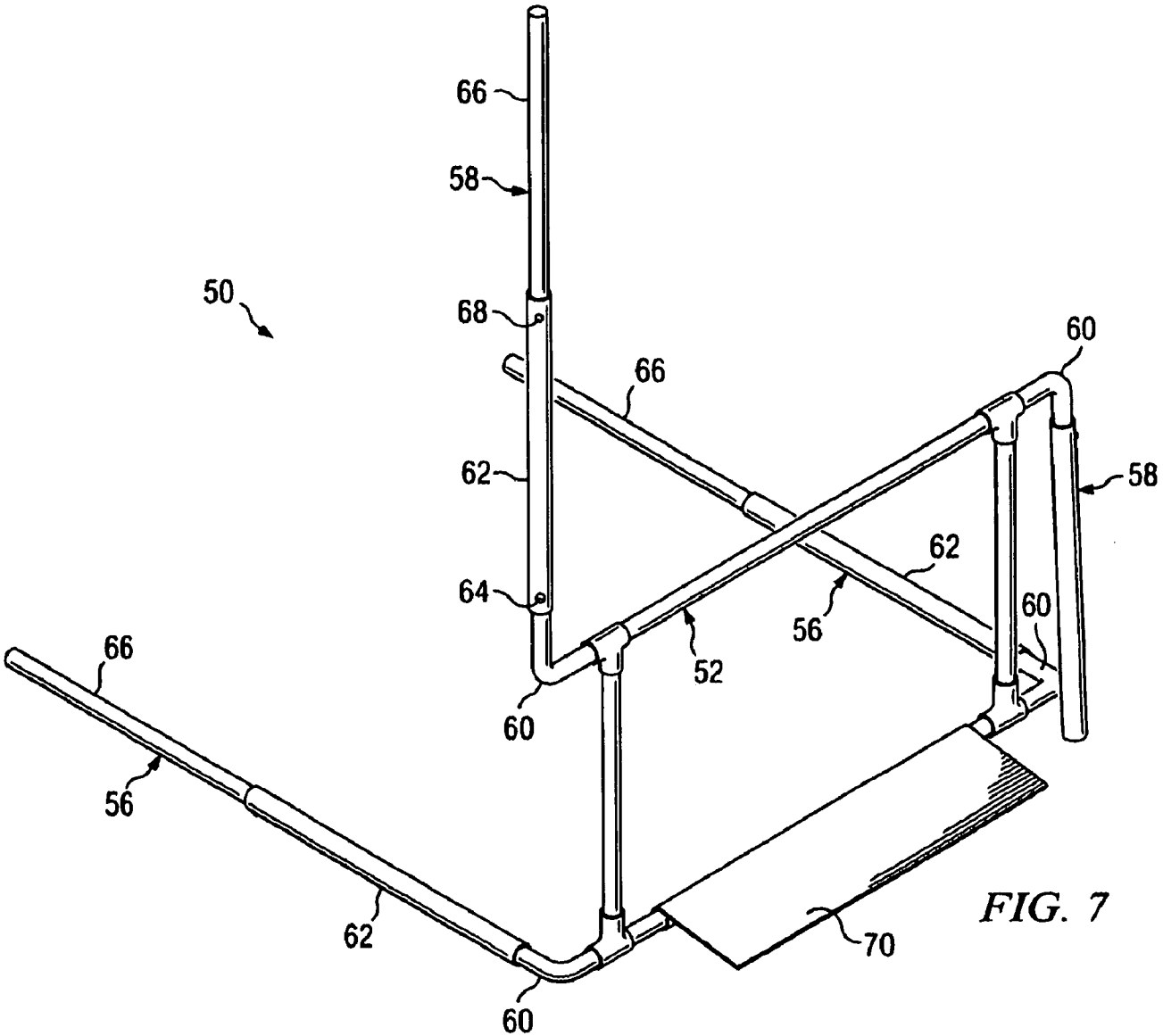
FIG. 7 is a perspective view showing the device of FIG. 4 in a fourth orientation.

FIG. 7 illustrates the refuse bag supporting device 50 with the frame 52 thereof oriented vertically. When in the vertical orientation, the frame 52 receives and supports a refuse bag with the bag extending horizontally. Positioning of the frame 52 of the device 50 as illustrated in FIG. 7 is facilitated by extending the legs 56 and engaging them with the underlying surface. One of the legs 58 may be extended and positioned vertically to serve as a handle for positioning and locating the refuse bag supporting device 50. The opposite leg 58 may be retracted and folded so as to be out of the way. A ramp 70 may be used to facilitate the filling of a refuse bag supported by the device 50 with refuse.

Figure 8:
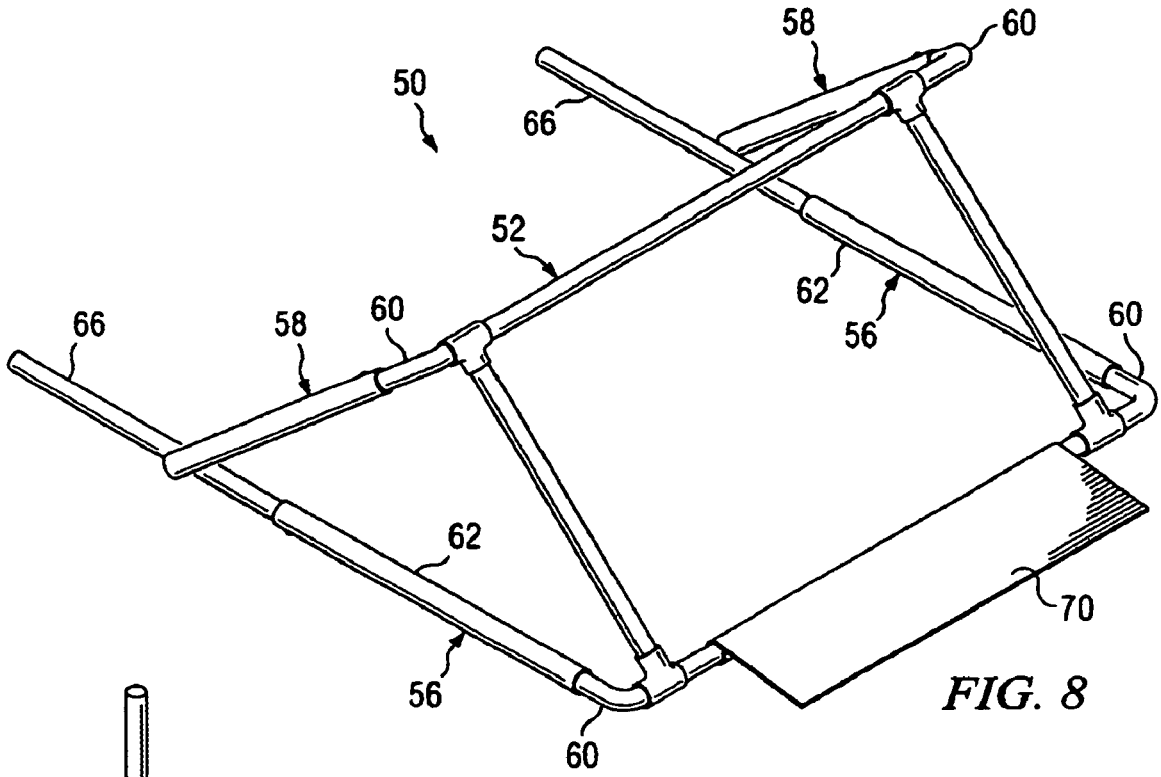
FIG. 8 is a perspective view showing the device of FIG. 4 in a fifth orientation.

FIG. 8 illustrates the refuse bag supporting device 50 configured with the frame 52 thereof extending angularly. The legs 56 of the device 50 are fully extended and engage the underlying surface. The legs 58 are retracted and extend into engagement with the underlying surface adjacent to the legs 56.

Figure 9:
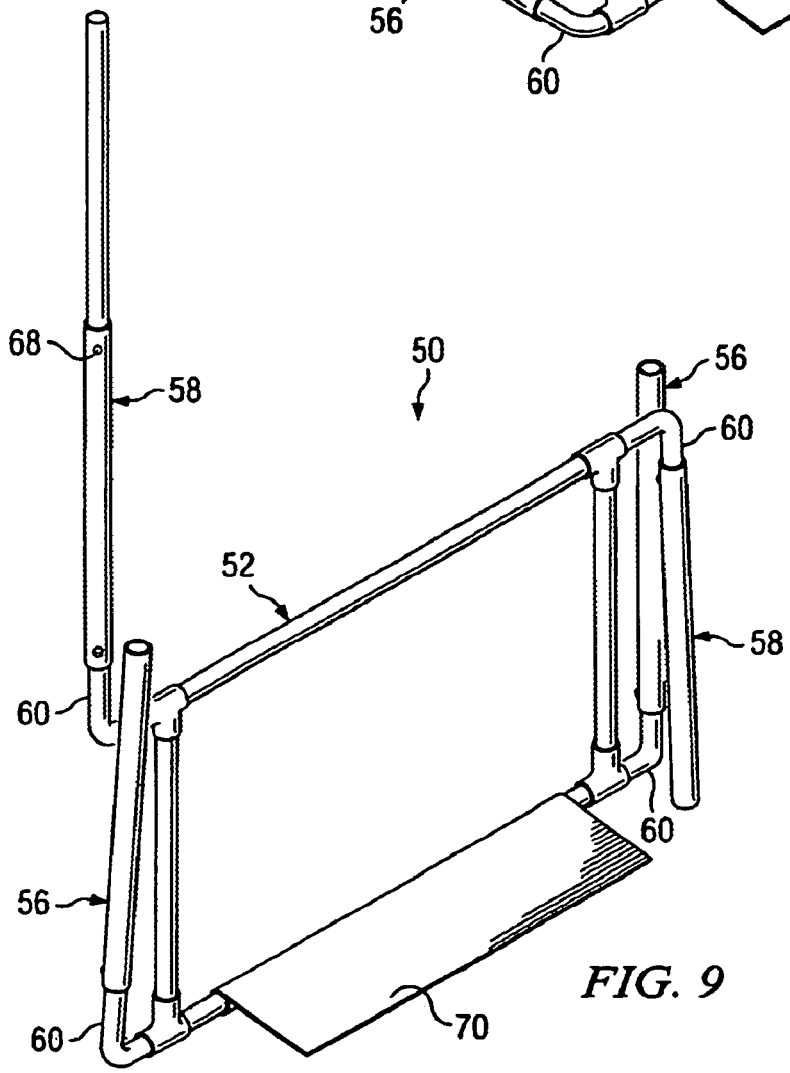
FIG. 9 is a perspective view showing the device of FIG. 4 in a sixth orientation.

FIG. 9 illustrates the refuse bag supporting device 50 configured in a substantially folded condition with the frame 52 thereof oriented vertically. The legs 56 are retracted and folded upwardly. One of the legs 58 is retracted and folded downwardly. The other leg 58 is extended and pivoted upwardly to serve as a handle for the device 50.

Referring to FIGS. 10 through 14, inclusive, there is shown a refuse bag supporting device 72 comprising a second embodiment of the present invention. Many of the component parts of the device 72 are substantially identical in construction and function to component parts of the refuse bag support device 50 as illustrated in FIGS. 4 through 9, inclusive, and described hereinabove in connection therewith. Such component parts of the refuse bag supporting device 72 are designated in FIGS. 10 through 14 with the same reference numerals utilized above in the description of the refuse bag supporting device 50 but are differentiated therefrom by a prime (') designation.

The refuse bag supporting device 72 includes a frame 52' which receives and supports a refuse bag. The frame 52' comprises four tubular structural members 53' which are connected one to another by corner members 54'. A plurality of legs 56' and 58' are pivotally connected to the corner members 54'. Having particular reference to FIGS. 10 and 11, the legs 56' are located relatively closely to the frame 52' and the leg 58' is located relatively outwardly therefrom. Also, two of the legs 56' are supported for pivotal movement in planes extending perpendicularly to the major dimension of the frame 52' while the third leg 56' and the leg 58' are supported for pivotal movement in planes extending parallel thereto.

Each of the legs 56' and 58' comprises an L-shaped member 60' which is pivotally connected to one of the corner members 54'. Each leg 56' and 58' further comprises a relatively large diameter tubular member 62' which is secured to the adjacent L-shaped member 60' by a bayonet connector 64'. Each leg 56' and 58' further includes a relatively small diameter tubular member 66' which is secured to the relatively large diameter tubular member 62' by a bayonet connector 68'.

Figure 10:
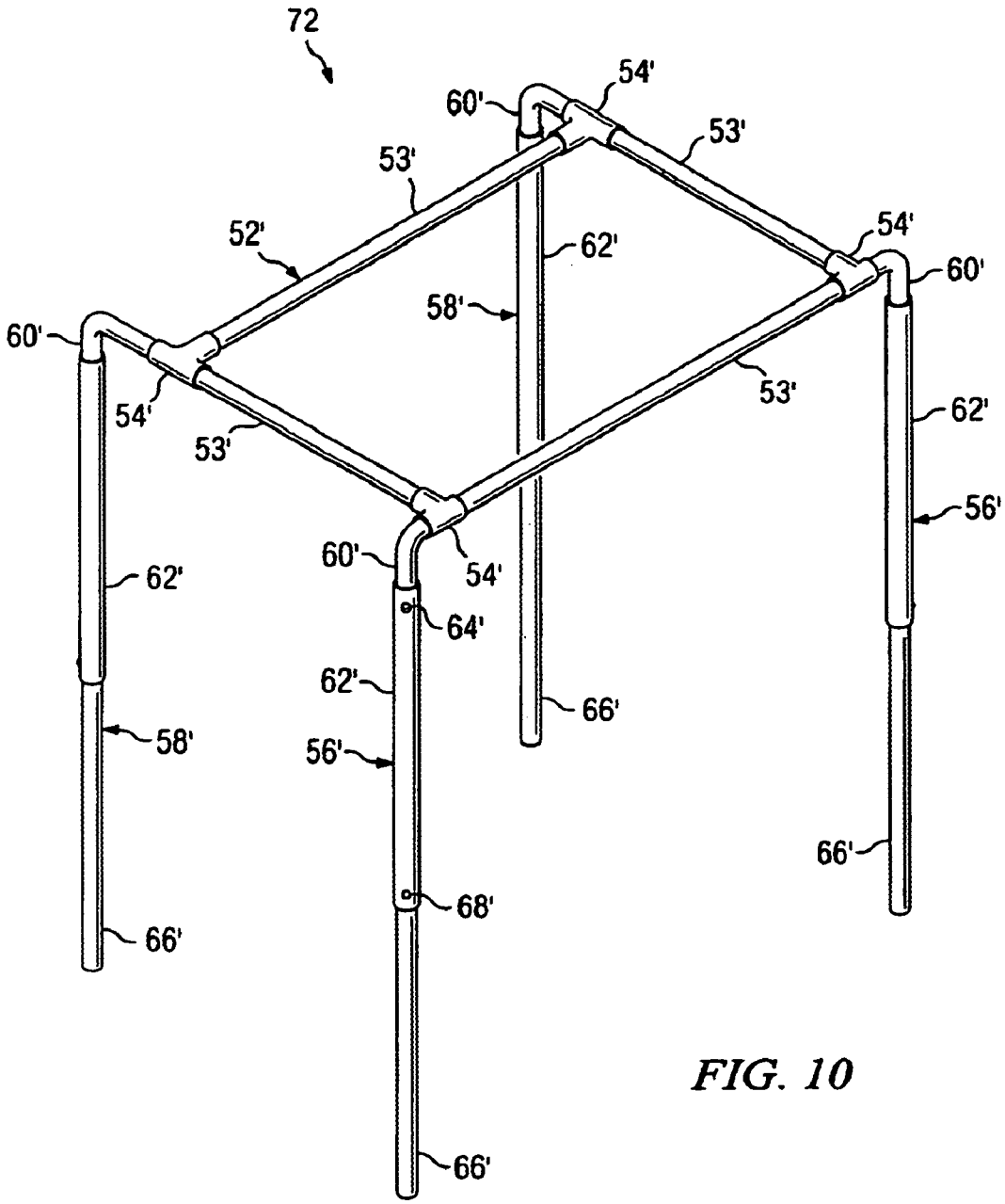
FIG. 10 is a perspective view showing a refuse bag supporting device comprising a second embodiment of the present invention in a first orientation.
Figure 11:
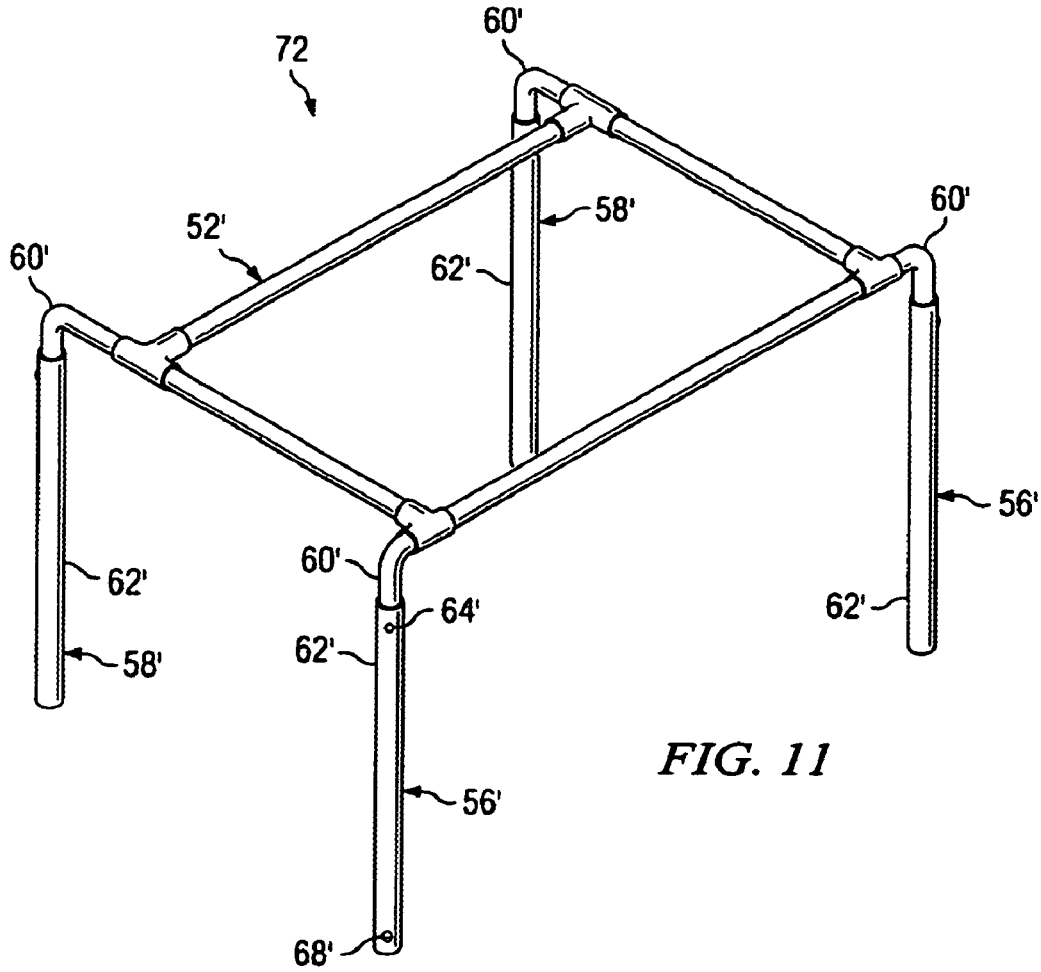
FIG. 11 is a perspective view showing the device of FIG. 10 in a second orientation.

FIG. 10 illustrates the refuse bag supporting device 72 with the legs 56' and 58' thereof fully extended. This positions the frame 52' of the device 72 at a height convenient for receiving and supporting a relatively long refuse bag. FIG. 11 illustrates the refuse bag supporting device 72 with the relatively small diameter sections 66' of the legs 56' and 58' retracted into the relatively large diameter sections 62' thereof. This positions the frame 52' of the device 72 at a reduced height suitable for receiving the supporting relatively short refuse bags.

Figure 12:
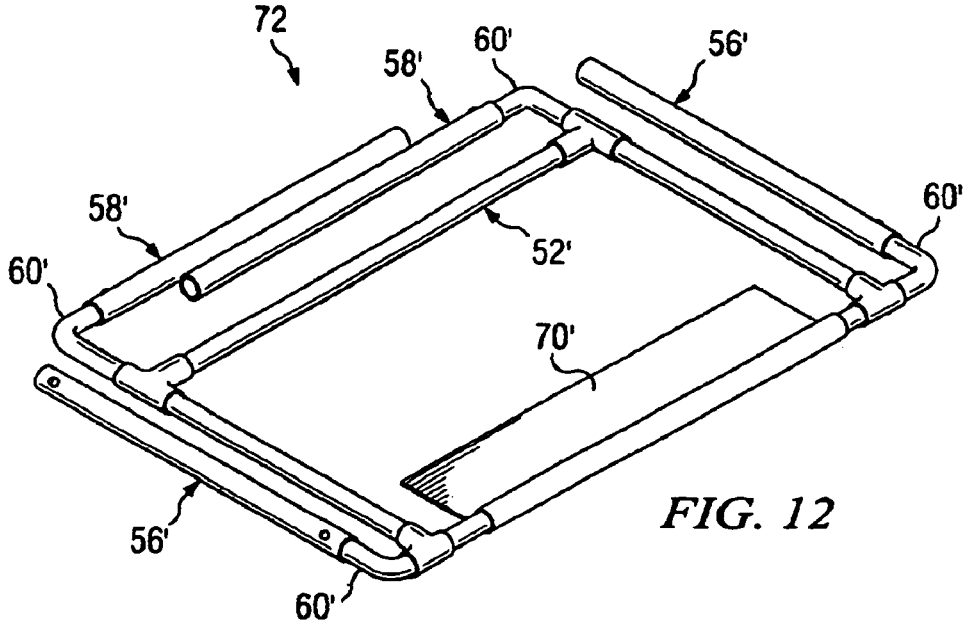
FIG. 12 is a perspective view showing the device of FIG. 10 in a third orientation.

FIG. 12 illustrates the refuse bag supporting device 72 folded for storage, transportation, etc. Folding of the device 72 is accomplished by retracting the legs 56' and 58', then pivoting two of the legs 56' toward the leg 58', and pivoting the third leg 56' and the leg 58' toward one another.

Figure 13:
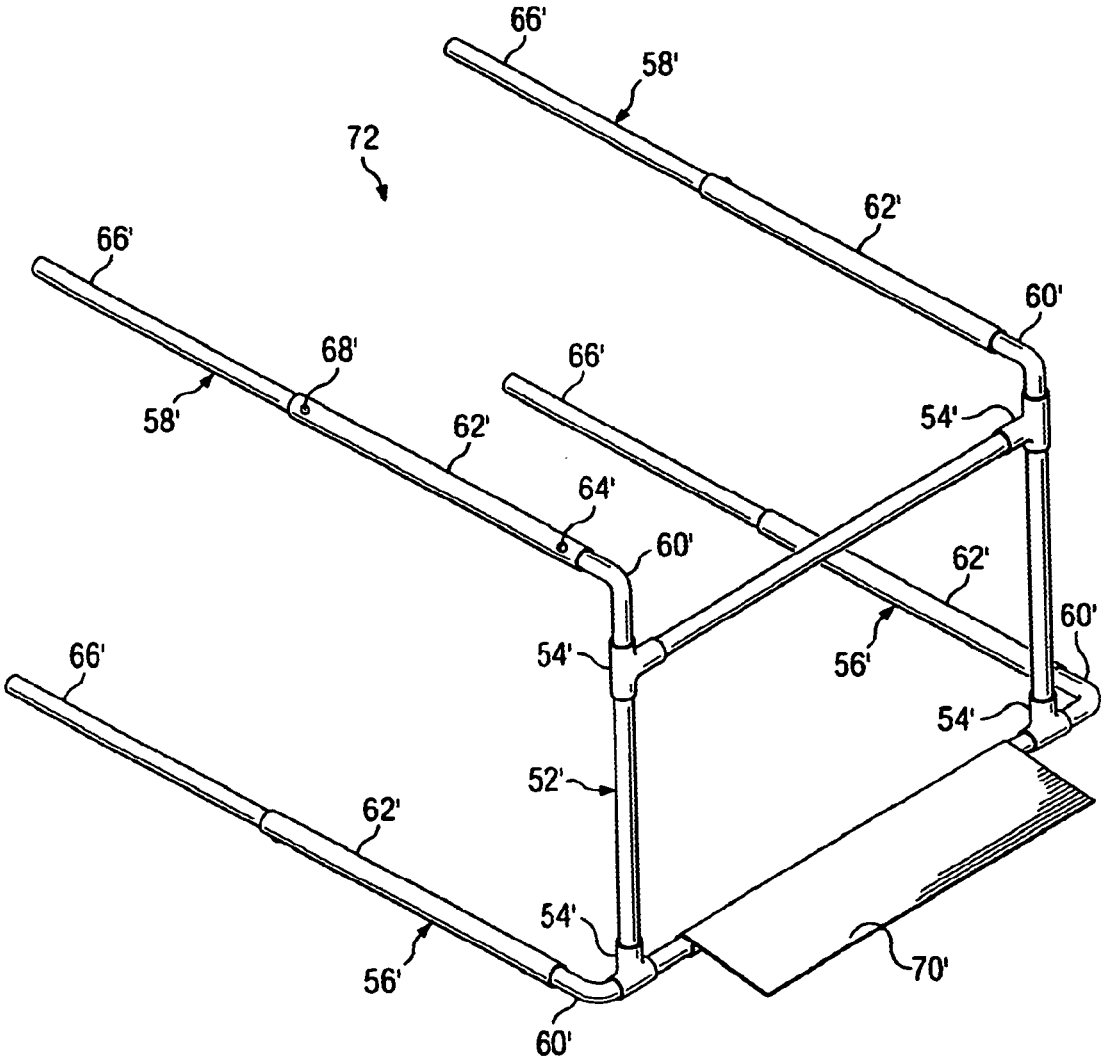
FIG. 13 is a perspective view showing the device of FIG. 10 in a fourth orientation.

FIG. 13 illustrates the refuse bag supporting device 72 with the frame 52' thereof oriented vertically. When in the vertical orientation, the frame 52' receives and supports a refuse bag with the refuse bag extending horizontally. Positioning of the frame 52' of the device 72 as illustrated in FIG. 7 is facilitated by extending the legs 56' and engaging them with the underlying surface. A ramp 70' may be used to facilitate the filling of a refuse bag supported by the device 72 with refuse.

Figure 14:
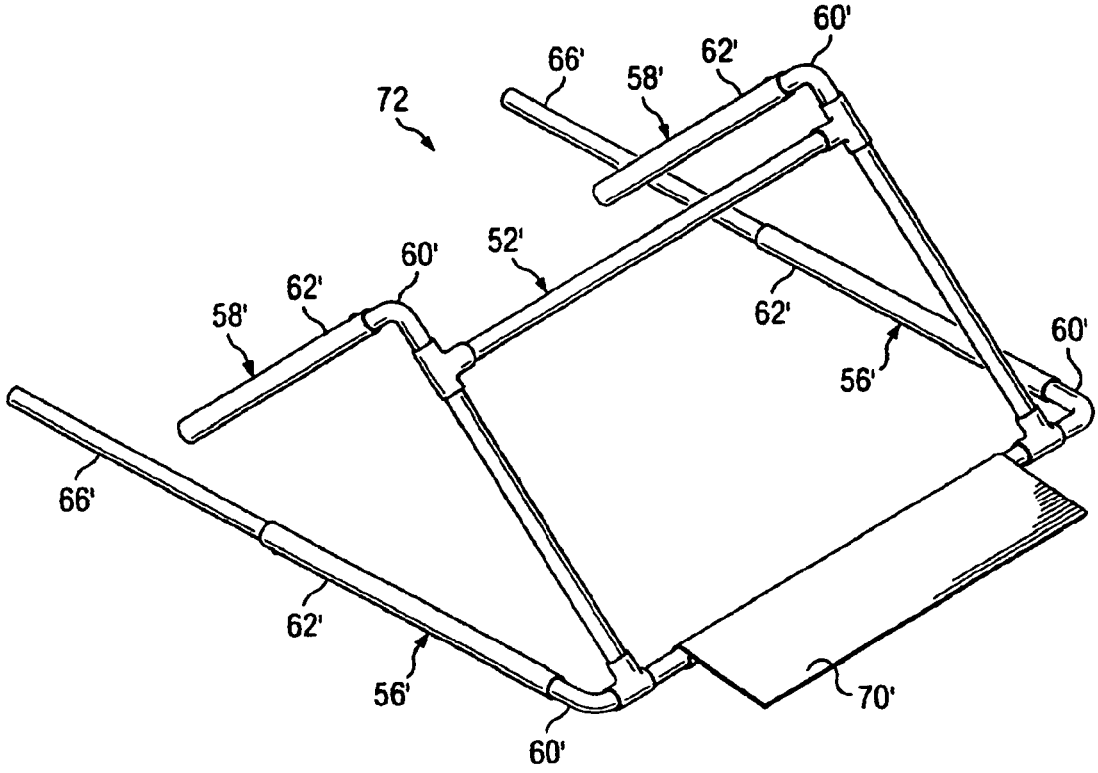
FIG. 14 is a perspective view showing the device of FIG. 10 in a fifth orientation.

FIG. 14 illustrates the refuse bag supporting device 72 configured with the frame 52' thereof extending angularly. Two of the legs 56' of the device 72 are fully extended and engage the underlying surface. The leg 58' and the third leg 56' are retracted and extend into engagement with the underlying surface adjacent to the extended legs 56'.

Referring to FIGS. 15 through 19, inclusive, there is shown a refuse bag supporting device 74 comprising a third embodiment of the present invention. Many of the component parts of the device 72 are substantially identical in construction and function to component parts of the refuse bag support device 50 as illustrated in FIGS. 4 through 9, inclusive, and described hereinabove in connection therewith. Such component parts of the refuse bag supporting device 72 are designated in FIGS. 10 through 14 with the same reference numerals utilized above in the description of the refuse bag supporting device 50 but are differentiated therefrom by a double prime (") designation.

The refuse bag supporting device 74 includes a frame 52" which receives and supports a refuse bag. The frame 52" comprises three tubular structural members 52" which are connected one to another by corner members 54". A plurality of legs 56" and 58" are pivotally connected to the corner members 54". Having particular reference to FIGS. 4 and 5, the legs 56" are located relatively closely to the frame 52" whereas the leg 58" is located relatively outwardly therefrom.

Each of the legs 56" and 58" comprises an L-shaped member 60" which is pivotally connected to one of the corner members 54". Each leg 56" and 58" further comprises a relatively large diameter tubular member 62" which is secured to the adjacent L-shaped member 60" by a bayonet connector 64". Each leg 56" and 58" further includes a relatively small diameter tubular member 66" which is secured to the relatively large diameter tubular member 62" by a bayonet connector 68".

Figure 15:
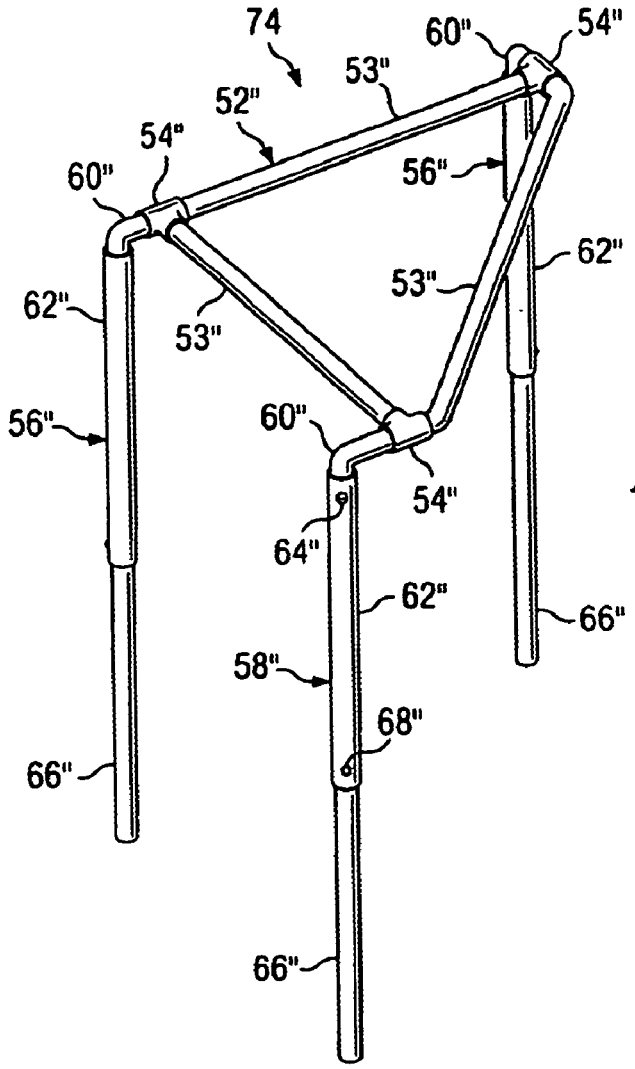
FIG. 15 is a perspective view showing a refuse bag supporting device comprising a third embodiment of the present invention in a first orientation.
Figure 16:
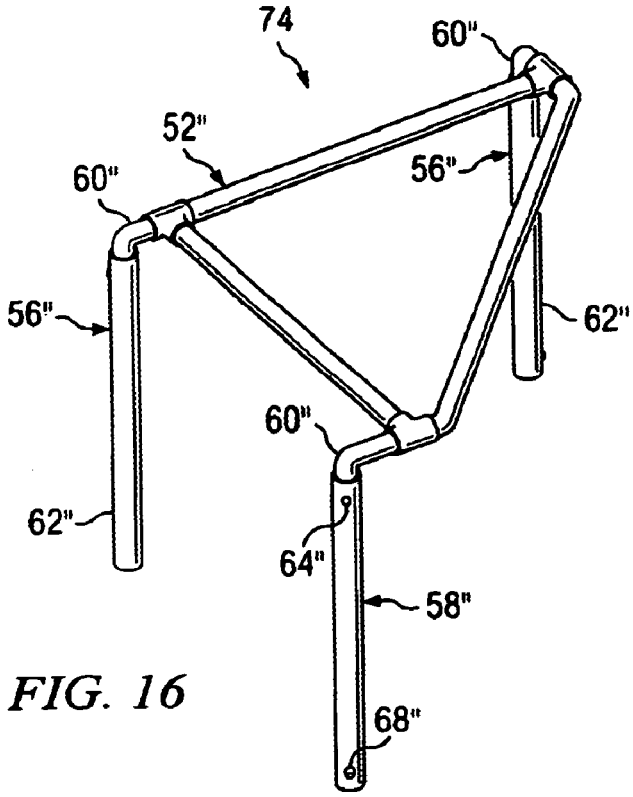
FIG. 16 is a perspective view showing the device of FIG. 15 in a second orientation.

FIG. 15 illustrates the refuse bag supporting device 74 with the legs 56" and 58" thereof fully extended. This positions the frame 52" of the device 74 at a height convenient for receiving and supporting a relatively long refuse bag. FIG. 16 illustrates the refuse bag supporting device 74 with the relatively small diameter sections 66" of the legs 56" and 58" retracted into the relatively large diameter sections 62" thereof. This positions the frame 52" of the device 74 at a reduced height suitable for receiving the supporting relatively short collection bags.

FIG. 17 illustrates the refuse bag supporting device 74 folded for storage, transportation, etc. Folding of the device 74 is accomplished by retracting the legs 56' and 58' and then pivoting the legs 56" and the legs 58" into the plane of the frame 52". Because the legs 56" are positioned relatively inwardly and the leg 58" is positioned relatively outwardly relative to the frame 52", one of the legs 56' folds into the space between the leg 58" and the frame 52".

FIG. 18 illustrates the refuse bag supporting device 74 with the frame 52" thereof oriented vertically. When in the vertical orientation, the frame 52" receives and supports a refuse bag with the refuse bag extending horizontally. Positioning of the frame 52" of the device 74 as illustrated in FIG. 7 is facilitated by extending one of the legs 56" and the leg 58" and engaging them with the underlying surface. The other leg 56" may be extended vertically to serve as a handle for positioning and locating the refuse bag supporting device 74. A ramp 72' may be used to facilitate the filling of a refuse bag supported by the device 74 with refuse.

Figure 19:
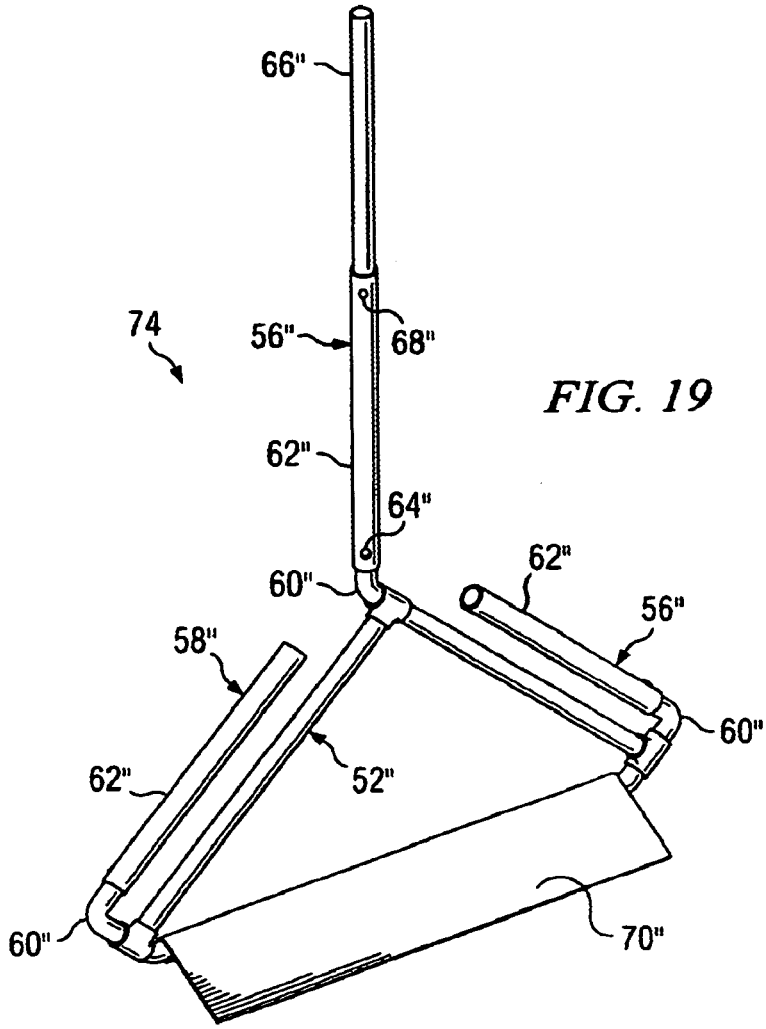
FIG. 19 is a perspective view showing the device of FIG. 15 in a fifth orientation.

FIG. 19 illustrates the refuse bag supporting device 74 configured in a substantially folded condition with the frame 52" thereof oriented vertically. One of the legs 56" and the leg 58" are retracted and folded into the plane of the frame 52". The other leg 56" is extended and pivoted upwardly to serve as a handle for the device 74.

Figure 20:
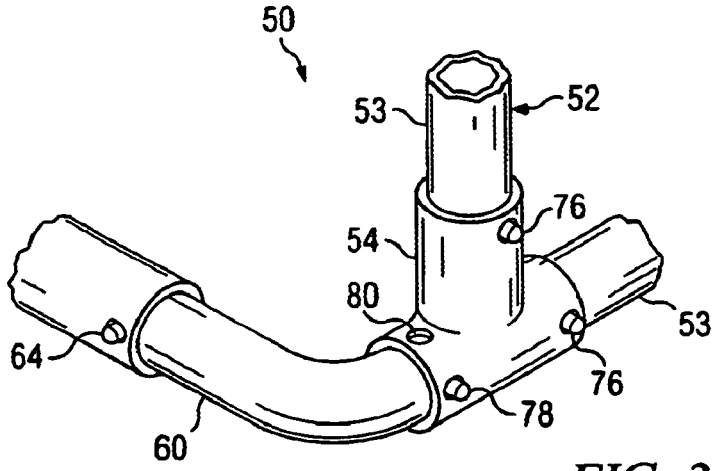
FIG. 20 is a partial perspective view illustrating a feature of the present invention.

Additional structural details relating to the refuse bag supporting device of the present invention are illustrated in FIG. 20. The structural details shown in FIG. 20 are described in conjunction with the refuse bag supporting device 50. However, as will be understood by those skilled in the art, the structural details of FIG. 20 are equally applicable to the refuse bag supporting device 72 and to the refuse bag supporting device 74.

The tubular members 53 comprising the frame 52 of the refuse bag supporting device 50 are secured to the corner members 54 thereof by bayonet connectors 76. Each L-shaped member 60 is secured to the adjacent corner member 54 by a bayonet connector 78. The corner member 54 may be provided with additional apertures 80 to facilitate securing the L-shaped member 60 and the leg secured thereto in various rotational positions relative to the frame 52.

FIGS. 21 through 24, inclusive, illustrate various devices for securing refuse bags to the refuse bag supporting device of the present invention. The securing device of FIGS. 21, 22, 23, and 24 are illustrated and described in conjunction with the refuse bag supporting device 50. However, as will be understood by those skilled in the art, the refuse bag securing devices of FIGS. 21 through 24 are equally applicable to the refuse bag supporting device 72 and to the refuse bag supporting device 74.

Figure 21:
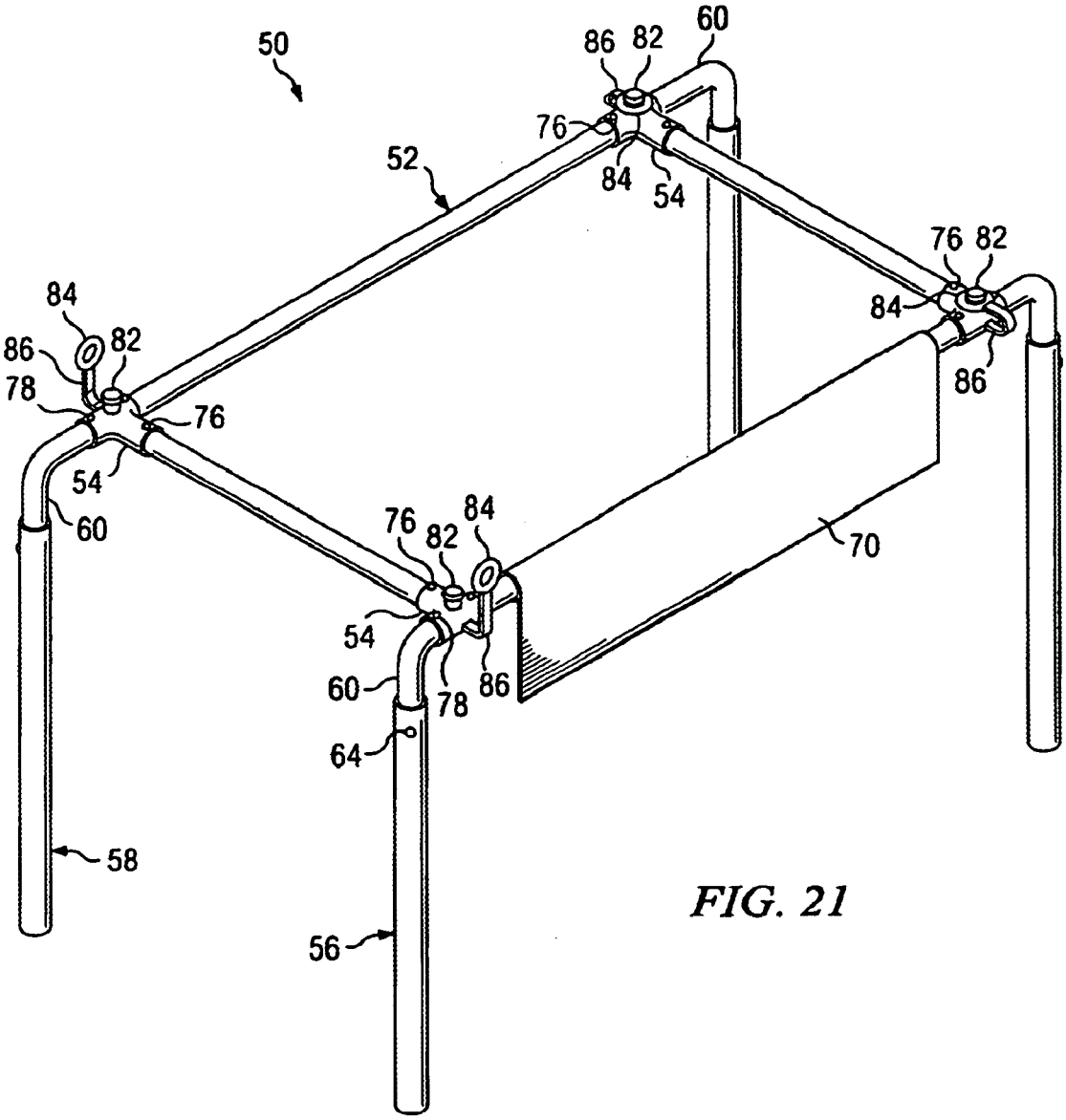
FIG. 21 is a perspective view illustrating a first apparatus for securing bags to a refuse bag supporting device of the present invention.

Referring particularly to FIG. 21, a refuse bag securing knob 82 may be formed integrally with or secured to each of the corner members 54. A refuse bag retaining ring 84 is secured to each of the corner members 54 by a flexible member 86. In the use of the device shown in FIG. 21, the polymeric film comprising a refuse bag is positioned over the retaining knobs 82 and is secured in engagement with the retaining knobs 82 by the retaining rings 84 which clasp the polymeric material comprising the refuse bag in engagement with the retaining knobs 82. The refuse bag may be further secured to the frame 52 comprising the refuse bag supporting device 50 by engagement of the ramp 70 with the frame 52.

Figure 22:
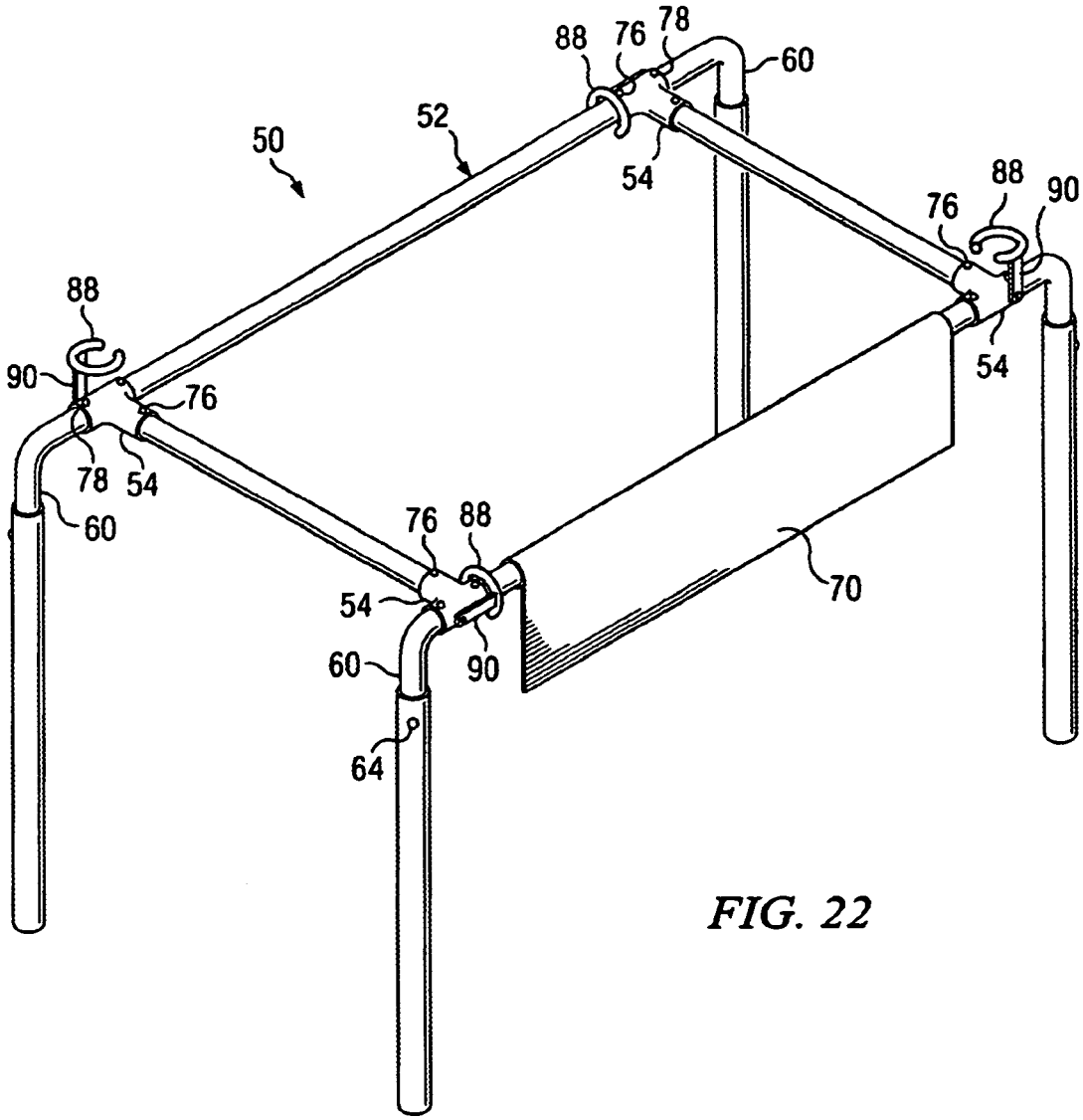
FIG. 22 is a perspective view illustrating a second apparatus for securing refuse bags to a refuse bag supporting device of the present invention.

Referring to FIG. 22, a retaining ring 88 may be secured to each of the corner members 54 by a connector 90. The polymeric film comprising a refuse bag is positioned over the corner members 54 and is secured in engagement therewith by engaging the securing rings 88 with their respective corner members 54. The securing rings 88 function to trap the polymeric material comprising the refuse bag in engagement with the corner members 54. The refuse bag may be further secured to the frame 52 comprising the refuse bag supporting device 50 by engagement of the ramp 70 with the frame 52.

Figure 23:
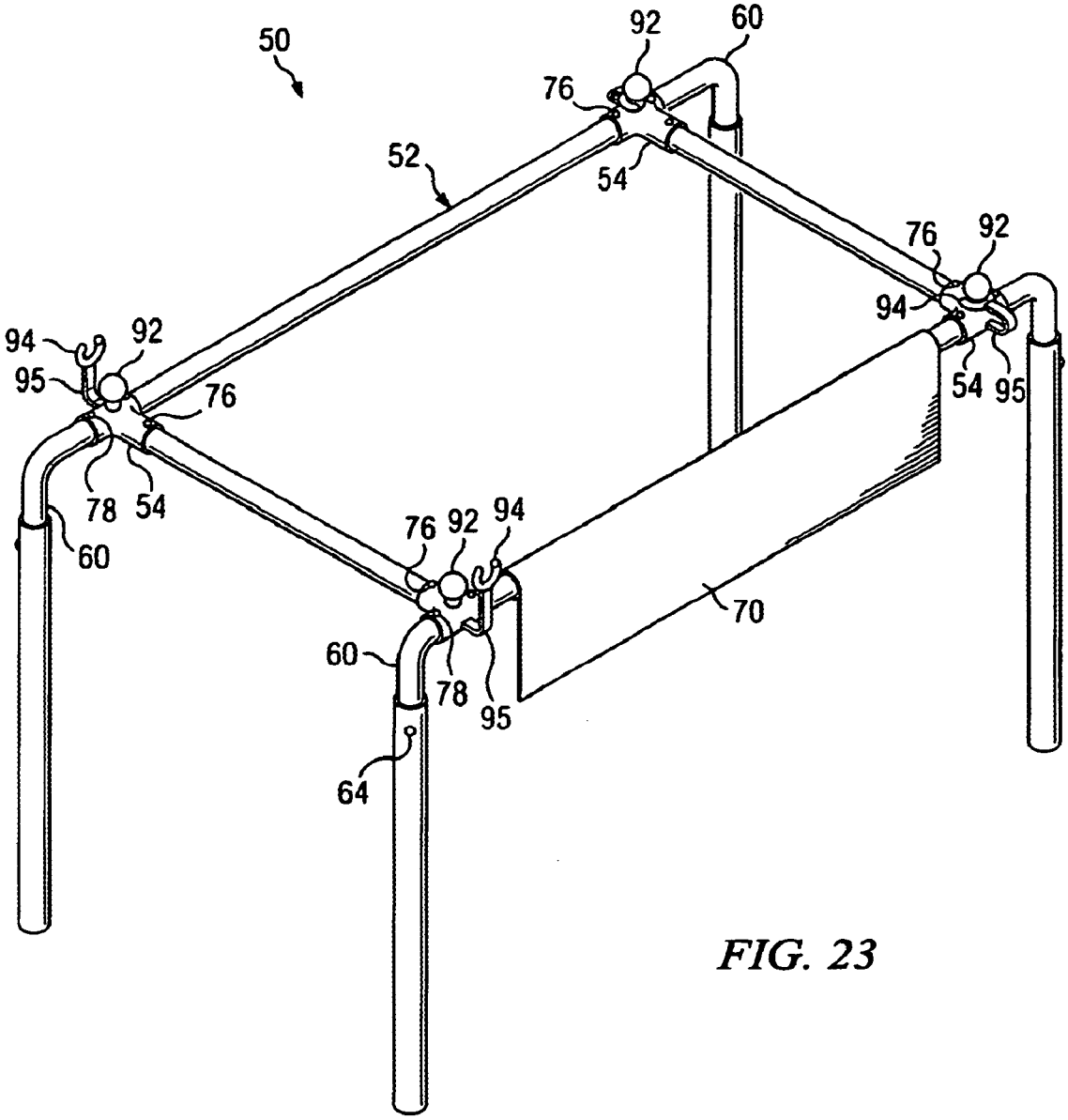
FIG. 23 is a perspective view illustrating a third apparatus for securing refuse bags to a refuse bag supporting device of the present invention.

Referring to FIG. 23, a securing knob 92 may be formed integrally with or secured to each of the corner members 54. A retaining ring 94 is secured to each of the corner members 54 by a flexible member 95. In the use of the device shown in FIG. 23, the polymeric material comprising a refuse bag is extended over the retaining knobs 92 and is secured in engagement therewith by the securing rings 94 which trap the polymeric material comprising the refuse bag in engagement with the retaining knobs 92. The refuse bag may be further secured to the frame 52 comprising the refuse bag supporting device 50 by engagement of the ramp 70 with the frame 52.

Figure 24:
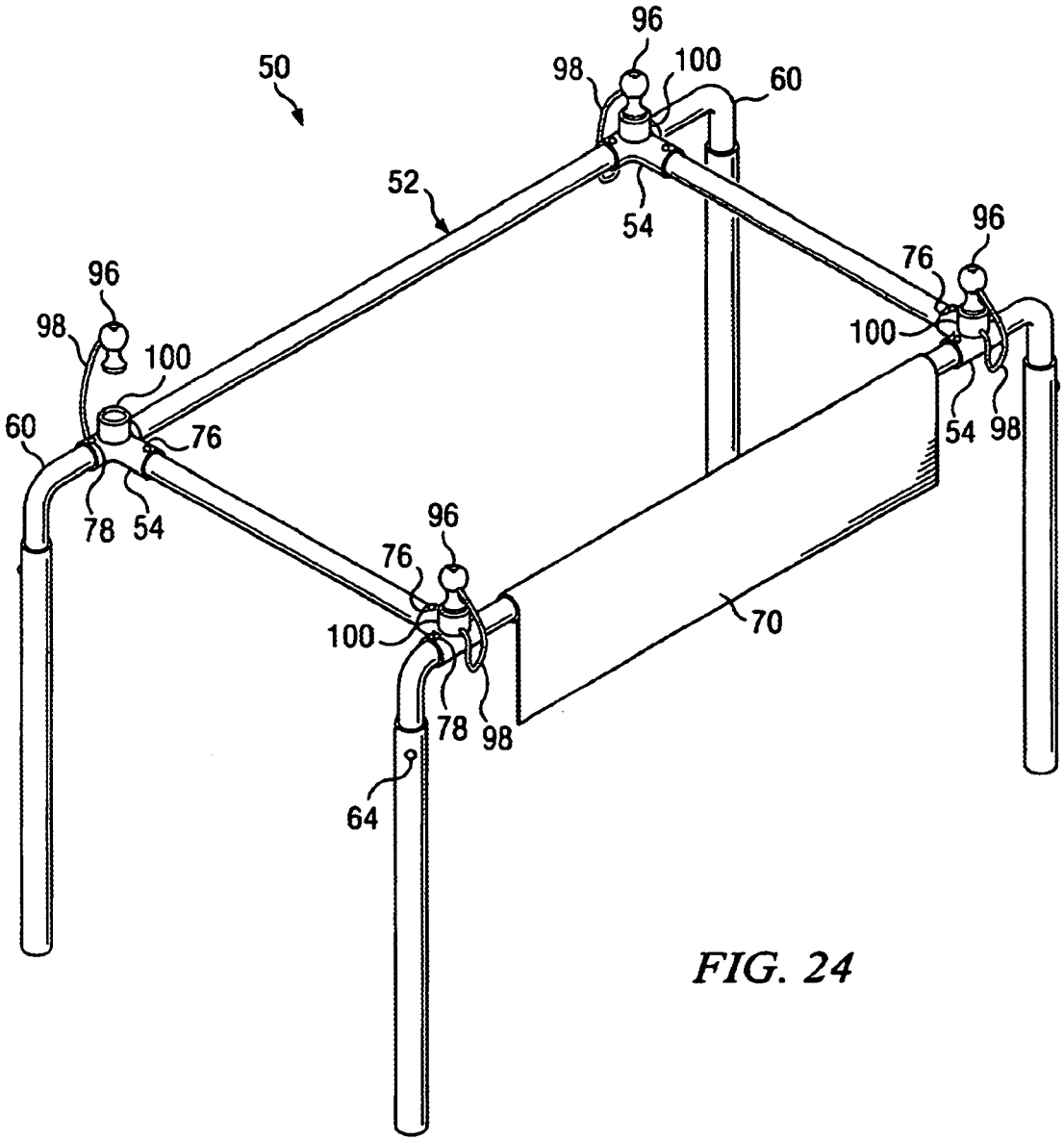
FIG. 24 is a perspective view illustrating a fourth apparatus for securing refuse bags to a refuse bag supporting device of the present invention.

Referring to FIG. 24, a refuse bag retaining plug 96 may be secured to each of the corner members 54 by a flexible member 98. A plug receiving aperture 100 may be formed integrally with or secured to each of the corner members 54. In the use of the device shown in FIG. 24, the polymeric material comprising a refuse bag is extended over the corner members 54 and the plug receiving apertures 100. The plugs 96 are then engaged with the apertures 100 with the polymeric material comprising the refuse bag trapped therebetween. The refuse bag may be further secured to the refuse bag supporting device 50 by securing the ramp 70 in engagement with the frame thereof.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

The invention claimed is:

1. A refuse bag supporting device comprising:

a plurality of refuse bag supporting members, a plurality of corner members joining the refuse bag supporting member end to end to define a refuse bag supporting frame;

a plurality of legs for positioning the refuse bag supporting frame in a plurality of orientations including a substantially horizontal orientation and a substantially vertical orientation;

means for supporting each of the legs on the frame for pivotal movement with respect thereto between a first orientation, wherein the leg extends perpendicularly relative to the frame at a second orientation wherein the leg extends parallel relative to the frame;

each of the legs comprising a relatively large diameter tubular member and a relatively small diameter tubular member which is slidably received in the relatively large diameter tubular member;

means for selectively retaining each of the legs in an extended configuration and in a retracted configuration relative to the frame;

the means for pivotally supporting the legs on the frame comprising a plurality of L-shaped members each extending between one of the corner members of the frame and one of the legs;

at least one of the L-shaped members supporting one of the legs relatively outwardly with respect to the frame; and at least one of the L-shaped members supporting one of the legs relatively inwardly with respect to the frames.

* * * * *